US005201448A

United States Patent [19]

Schue

[11] Patent Number: 5,201,448

[45] Date of Patent: Apr. 13, 1993

[54] UTILITY BELT WITH BACK SUPPORT

[76] Inventor: Richard M. Schue, 2313 34th Ave. S., Fargo, N. Dak. 58104

[21] Appl. No.: 786,098

[22] Filed: Oct. 31, 1991

[51] Int. Cl.[5] ..... B25H 3/00; B25B 29/00

[52] U.S. Cl. ..... 224/253; 224/226; 224/904; 2/300

[58] Field of Search ..... 224/224–228, 224/253, 255, 256, 904, 249; 2/300, 328, 300, 321, 322, 338; 602/19, 36

[56] References Cited

U.S. PATENT DOCUMENTS

| | | | |
|---|---|---|---|
| 652,891 | 7/1900 | Cochran | 224/225 |
| 1,292,728 | 1/1919 | Dozier | 224/253 X |
| 1,774,222 | 8/1930 | Bermejo et al. | 2/300 X |
| 3,533,540 | 10/1970 | Carinci | 224/253 X |
| 3,561,434 | 2/1971 | Kilbey | 602/36 |
| 3,635,430 | 1/1972 | Emond et al. | 224/249 X |
| 3,920,008 | 11/1975 | Lehman | 128/96.1 |
| 4,099,524 | 7/1978 | Cueman et al. | 602/19 |
| 4,384,372 | 5/1983 | Rector | 2/300 |
| 4,682,587 | 7/1987 | Curlee | 602/13 |
| 4,747,527 | 5/1988 | Trumpower, II | 224/224 |
| 4,923,105 | 5/1990 | Snyder | 224/255 |
| 5,064,108 | 11/1991 | Headley | 224/253 |
| 5,067,643 | 11/1991 | McKinney | 224/224 X |

FOREIGN PATENT DOCUMENTS

| | | | |
|---|---|---|---|
| 88/03461 | 5/1988 | PCT Int'l Appl. | 224/904 |

*Primary Examiner*—Henry J. Recla
*Assistant Examiner*—Casey Jacyna
*Attorney, Agent, or Firm*—Zarley, McKee, Thomte, Voorhees & Sease

[57] ABSTRACT

A construction utility belt includes an elongated belt having a wide mid portion tapering to narrower first and second ends. A buckle is mounted on the first end of the belt and is operably connectable to the second end of the belt. The mid portion of the belt has a thickness and width so as to provide abdominal and lower back support when the belt is tightened around the lower abdomen of a person. A pair of slots are formed along the longitudinal axis of the belt and spaced apart from the mid portion so as to support a pair of pouches. A flap from each pouch extends through the respective slot and is folded back upon itself and fastened in position.

2 Claims, 2 Drawing Sheets

UTILITY BELT WITH BACK SUPPORT

TECHNICAL FIELD

The present invention relates generally to utility belts for construction workers, and more particularly to an improved belt having functional back support and removable slidable pockets.

BACKGROUND OF THE INVENTION

Low back pain has been reported as the third major cause of disability in the United States. Construction workers who traumatize their backs are subjected to pain, discomfort, and work absenteeism; and in some cases the injury necessitates that they leave their trade.

The traditional approach to alleviating such injuries has been an educational process describing safe lifting procedures and proper body mechanics. However, this approach has not been totally effective.

It is therefore a general object of the present invention to provide an improved utility belt for construction workers which provides mechanical and functional back support.

Another object of the present invention is to provide a construction utility belt which can be worn to mechanically assist in lifting, as well as in a conventional position for holding tools of the trade.

A further object of the present invention is to provide a construction utility belt with a broad back support which evenly disperses the weight of interchangeable pockets.

Yet a further object is to provide a construction utility belt with adjustably mounted pockets for comfortable positioning.

These and other objects will be apparent to those skilled in the art.

SUMMARY OF THE INVENTION

The construction utility belt of the present invention includes an elongated belt having a wide mid portion tapering to narrower first and second ends. A buckle is mounted on the first end of the belt and is operably connectable to the second end of the belt. The mid portion of the belt has a thickness and width so as to provide abdominal and lower back support when the belt is tightened around the lower abdomen of a person. A pair of slots are formed along the longitudinal axis of the belt and spaced apart from the mid portion so as to support a pair of pouches. A flap from each pouch extends through the respective slot and is folded back upon itself and fastened in position.

DESCRIPTION OF THE PREFERRED EMBODIMENT

Figure 1:
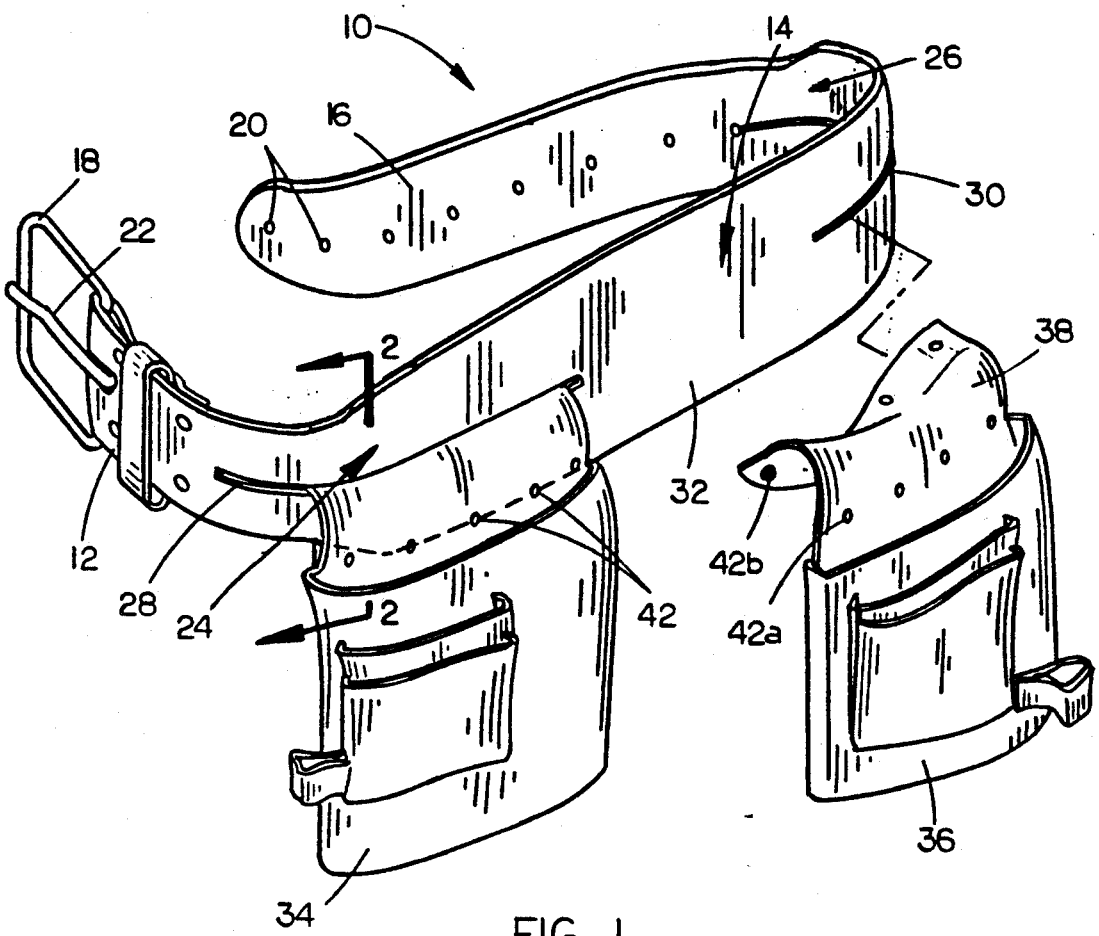
FIG. 1 is a pictorial view of the construction utility belt of the present invention.

Referring now to the drawings, in which similar or corresponding parts are identified with the same reference numeral, and more particularly to FIG. 1, the construction utility belt of the present invention is designated generally at 10 and includes a heavy soft leather belt having three distinct portions: a buckle portion 12, a mid portion 14, and end portion 16.

Utility belt 10 is preferably 32–52 inches long and approximately ¼ inch thick, similar to other prior art weight lifting belts. A buckle 18 is operably fastened to buckle portion 12 of belt 10, with a series of uniformly spaced apart apertures 20 formed in end portion 16 of belt 10, corresponding to the buckle prong 22. Preferably, buckle portion 12 and end portion 16 are approximately 2 ½ inches in width, while mid portion 14 is about 4–6 inches in width. The width of belt 10 tapers at each end of mid portion 14 designated generally as taper portions 24 and 26.

A first slot 28 is cut along the longitudinal axis of belt 10 and extends from a point on buckle portion 12, through taper portion 24 and into mid portion 14. A second slot 30 is also cut along the longitudinal axis of belt 10 and extends from end portion 16 through taper portion 26 and into mid portion 14. Slots 28 and 30 are separated by a solid section 32 in the middle of mid portion 14.

Figure 2:
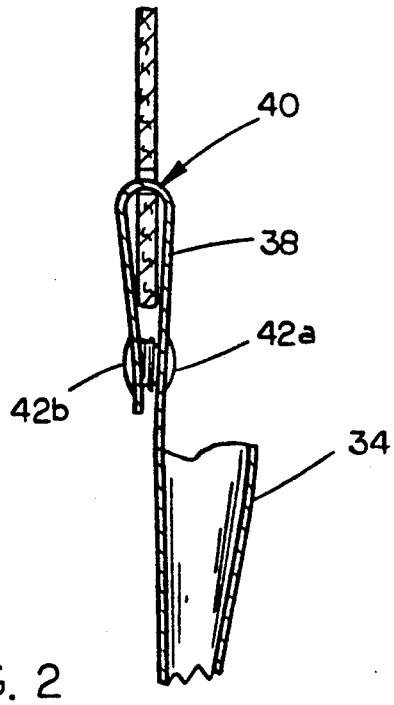
FIG. 2 is a sectional view taken at lines 2—2 in FIG. 1.

A pair of pouches 34 and 36 are each provided with a projecting back flap 38 which will extend through slots 28 or 30 and fold back on itself to form a loop 40, as shown in FIG. 2. A series of snaps 42 are mounted to back flaps 38 to selectively mount pouches 34 and 36 to belt 10. As shown in FIGS. 1 and 2, snaps 42 include one portion of the snap 42*a* mounted immediately above the upper edge of pouches 34 and 36 on back flap 38, and the corresponding half 42*b* mounted along the free edge of back flap 38. Preferably, back flaps 38 and pouches 34 and 36 have a width less than the length of slots 28 and 30 to permit longitudinal adjustment of pouches 34 and 36 along belt 10.

Figure 4:
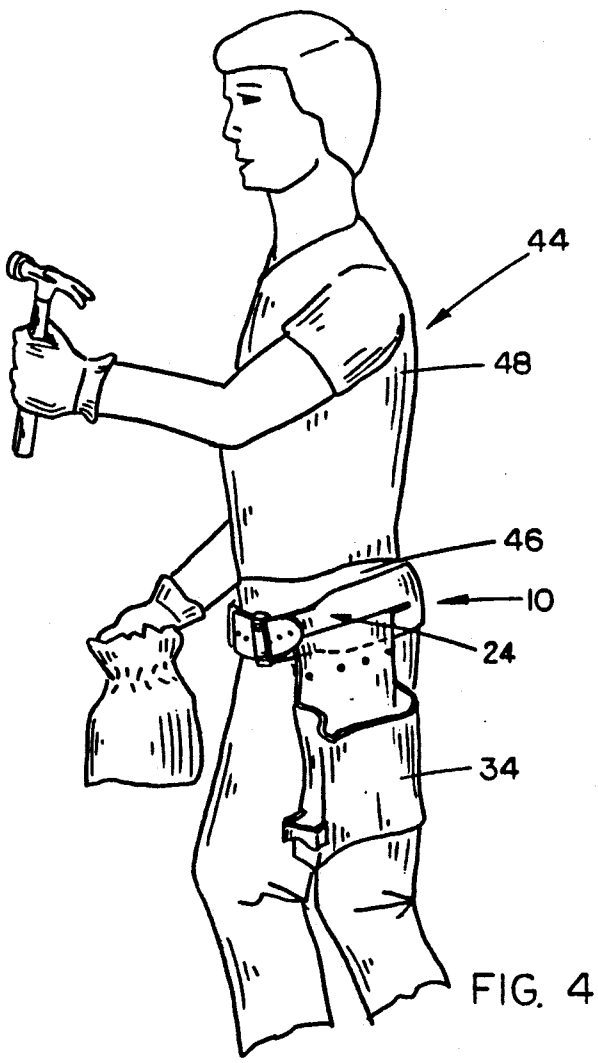
FIG. 4 is a side view of a person wearing the belt of the invention in a utility position.
Figure 3:
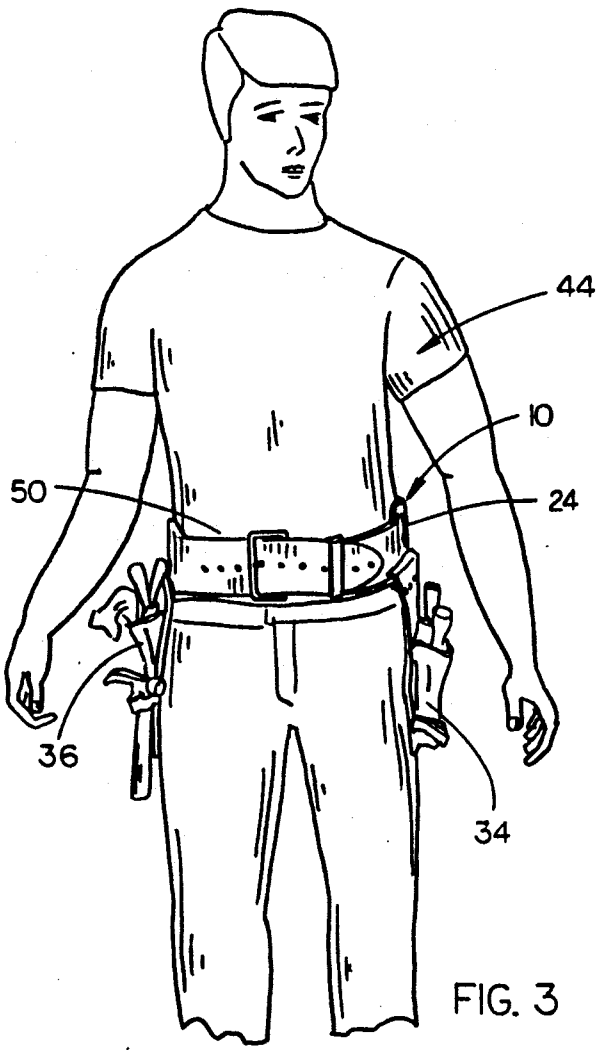
FIG. 3 is a front view of a person wearing the belt of the invention in a lifting position.

Referring now to FIGS. 3 and 4, construction utility belt 10 is designed for use in two different positions on the consumers body 44. The first position is shown in FIG. 4, wherein belt 10 is worn around the hips 46. This position is most comfortable for accessing pouches 34 and 36, and permits free movement of the torso 48. Because of the ¼ inch thickness and additional width of belt 10, it has been found that construction utility belt 10 will not curl or dig into the skin like traditional utility belts.

The second position for belt 10 is shown in FIG. 3, wherein belt 10 is raised and located about the abdomen 50. In this position, belt 10 should be tightened about abdomen 50 so as to provide intra-abdominal and thoracic-lumbar support to the body 44. The extra wide mid portion 14 of belt 10 thereby assists the wearer during lifting and the like by providing support to the lower back and the abdomen by spreading the base of support over a larger area of the lower back.

Whereas the invention has been shown and described in connection with the preferred embodiments thereof, it will be understood that many modifications, substitutions and additions may be made which are within the intended broad scope of the appended claims. There has therefore been shown and described an improved construction utility belt which accomplishes at least all of the above stated objects.

I claim:

1. A construction utility belt with back support, comprising:

an elongated belt having first and second end portions, a mid portion and upper and lower edges;

an operable buckle mounted to said first end portion;

said second end portion having apertures therein adapted for selective connection to said buckle;

said mid portion having a width, as measured transverse to the longitudinal axis, from the upper edge to the lower edge, greater than the width of said first and second end portions;

said mid portion having a thickness and width so as to provide abdominal and lower back support when the belt is tightened around the lower abdomen of a person;

said mid portion having a constant width greater than said first and second end portions and extending approximately one-fourth the length of the belt;

said belt including a first taper portion located between the first end portion and mid portion, and a second taper portion located between the second end portion and mid portion;

said taper portion upper and lower edges tapering equally towards the longitudinal axis of the belt such that the mid portion and end portions are coaxial;

a first slot through said belt along the longitudinal axis thereof to which article holding pouches may be attached, said first slot extending from said first end portion through said first taper portion and into said mid portion;

a second slot through said belt along the longitudinal axis thereof to which article holding pouches may be attached, said second slot extending from said second portion through said second taper portion and into said mid portion; and said first and second slots separated by a solid uncut section in the middle of said mid portion.

2. The belt of claim 1, further comprising:

a pouch with a back flap releasably connected through said first slot in said belt;

said back flap having a free edge extending from said pouch, and having a length to extend said free edge through said first slot, and thence folded back upon itself such that the free edge is removably connectable to a portion of the back flap; and fastener means for releasably connecting the free edge of the back flap to a portion of the back flap.

* * * * *